US007316546B2

(12) United States Patent
Daniëls et al.

(10) Patent No.: US 7,316,546 B2
(45) Date of Patent: Jan. 8, 2008

(54) SCREW COMPRESSOR

(75) Inventors: Ivo Daniëls, Boom (BE); Theofiel Karel Celina Claessens, Niel (BE)

(73) Assignee: Atlas Copco Airpower, Naamloze Vennootschap, Wilrijk (BE)

( * ) Notice: Subject to any disclaimer, the term of this patent is extended or adjusted under 35 U.S.C. 154(b) by 617 days.

(21) Appl. No.: 10/481,417

(22) PCT Filed: Jul. 5, 2002

(86) PCT No.: PCT/BE02/00116

§ 371 (c)(1),
(2), (4) Date: Dec. 30, 2003

(87) PCT Pub. No.: WO03/008808

PCT Pub. Date: Jan. 30, 2003

(65) Prior Publication Data

US 2004/0151602 A1 Aug. 5, 2004

(30) Foreign Application Priority Data

Jul. 17, 2001 (BE) ..... 2001/0484

(51) Int. Cl.
*F04B 49/00* (2006.01)
*F01C 1/16* (2006.01)

(52) U.S. Cl. ..... 417/295; 418/201.1

(58) Field of Classification Search ..... 417/298, 417/310, 237, 299, 307, 295; 418/201.2
See application file for complete search history.

(56) References Cited

U.S. PATENT DOCUMENTS 3,961,862 A 6/1976 Edstrom et al.
RE33,835 E * 3/1992 Kime et al. ..... 239/657

FOREIGN PATENT DOCUMENTS

| | | | |
|---|---|---|---|
| BE | 1012655 | A3 * | 2/2001 |
| EP | 0 629 778 | A2 | 3/1994 |
| EP | 1 004 774 | A2 | 5/2000 |
| JP | 2000-249070 | | 9/2000 |

OTHER PUBLICATIONS

Karassik, Igor J.; Messina, Joseph P.; Cooper, Paul; Heald, Charles C. (2001). Pump Handbook (3rd Edition). (pp. 7.6, 7.14). McGraw-Hill.□□Online version available at:□□http://www.knovel.com/knovel2/Toc.jsp?BookID=573&VerticalID=0.*

* cited by examiner

*Primary Examiner*—Devon C. Kramer
*Assistant Examiner*—Jessica L Frantz
(74) *Attorney, Agent, or Firm*—Bacon & Thomas, PLLC

(57) ABSTRACT

(57) The compressor comprises a compressor element (2) with a compression chamber (7), to which an inlet conduit (3) is connected, with an inlet valve (4) comprising a valve element (16) which is connected to a piston (13) which can be displaced in a housing (12). A control conduit (19) puts the pressure vessel (6) in the pressure conduit (5) into connection with the cylinder chamber (14) which is formed between the working side of the piston (13) and the housing (12). The valve element (16) is bypassed by a bypass (24) with a return valve (25). The cylinder chamber (14) is connected to the inlet conduit (3) by means of a connection conduit (20) which is provided with a controllable load valve (21) and, with open load valve (21) and, with open load valve (21), has a minimum flow section which is larger than that of the control conduit (19).

4 Claims, 2 Drawing Sheets

SCREW COMPRESSOR

The present invention relates to a volumetric compressor comprising a compressor element with a compression chamber, to which an inlet conduit, which can be closed off by means of an inlet valve, and a pressure conduit, in which a pressure vessel is installed, are connected, whereby the inlet valve comprises a valve element cooperating with a valve seat, said element being connected to a piston which can be displaced in a hollow space in a cylinder-forming housing, and a springy element which pushes this valve element towards the valve seat, whereas a control conduit puts the interior of the pressure vessel into connection with a cylinder chamber which is formed between the operative side of the piston and the housing.

Known screw compressors of this kind comprise a complicated complex of small channels, valves and springs for pneumatically controlling the inlet valve. From experience, it became evident that the reliability of this complex is not very high for controlling the inlet valve, especially with water-injected compressors. The operational reliability of the compressors is guaranteed under all operating conditions.

The invention relates to a volumetric compressor which remedies the aforementioned disadvantage and has a less complex and more reliable control of the inlet valve, such that the operational reliability thereof is guaranteed.

According to the invention, this aim is achieved in that the valve element is bypassed by a bypass with therein a return valve allowing only a flow towards the compression. chamber, and in that the cylinder chamber is connected to the inlet conduit by means of a connection conduit, with therein a load valve which can be controlled by means of a control device, whereby the minimum flow section of this connection conduit, with open load valve, is larger than the minimum flow section of the control conduit.

The construction which is necessary for the control of the inlet valve is simple and does not require many components. The inlet valve and the connection conduit with the load valve and possibly the bypass with the return valve can be incorporated in a relatively simple cast part. The working of the inlet valve is very reliable.

Figure 1:
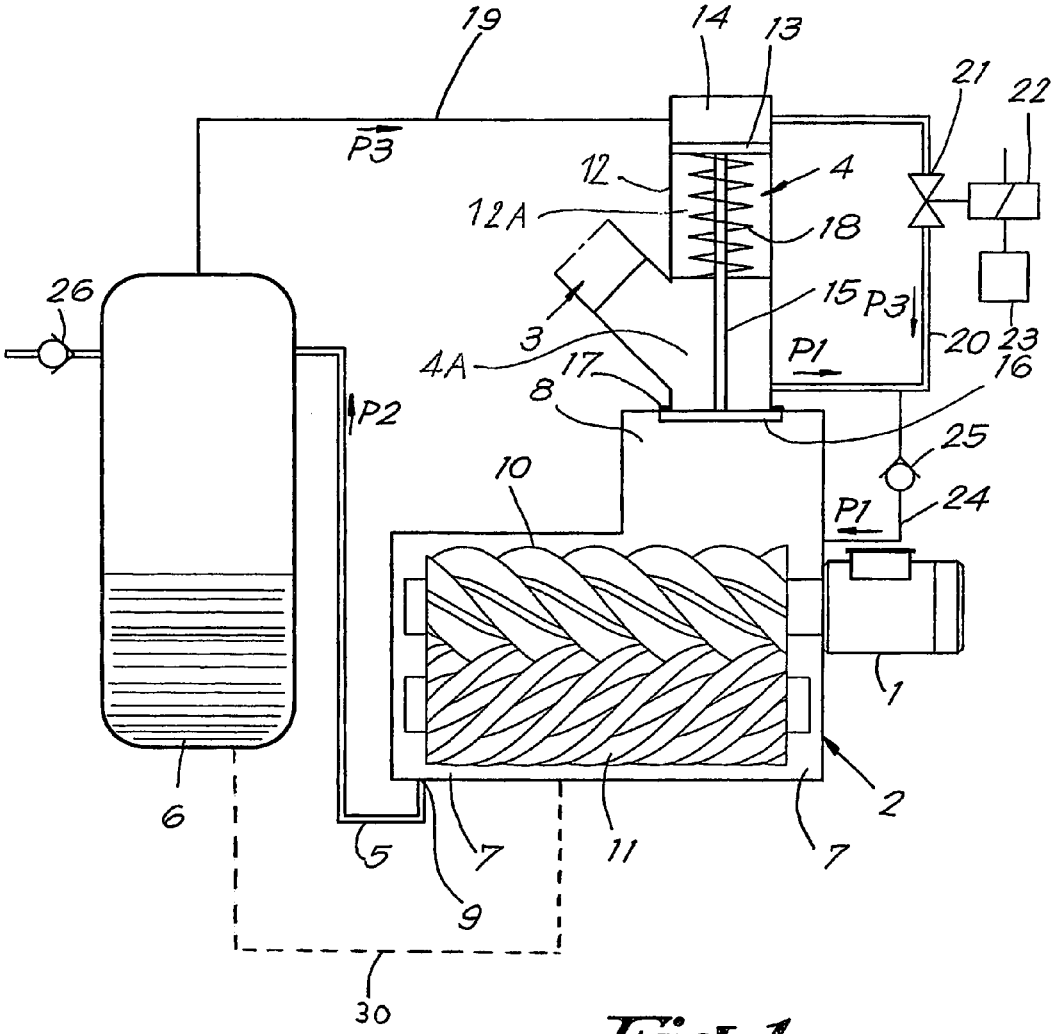
Figure 2:
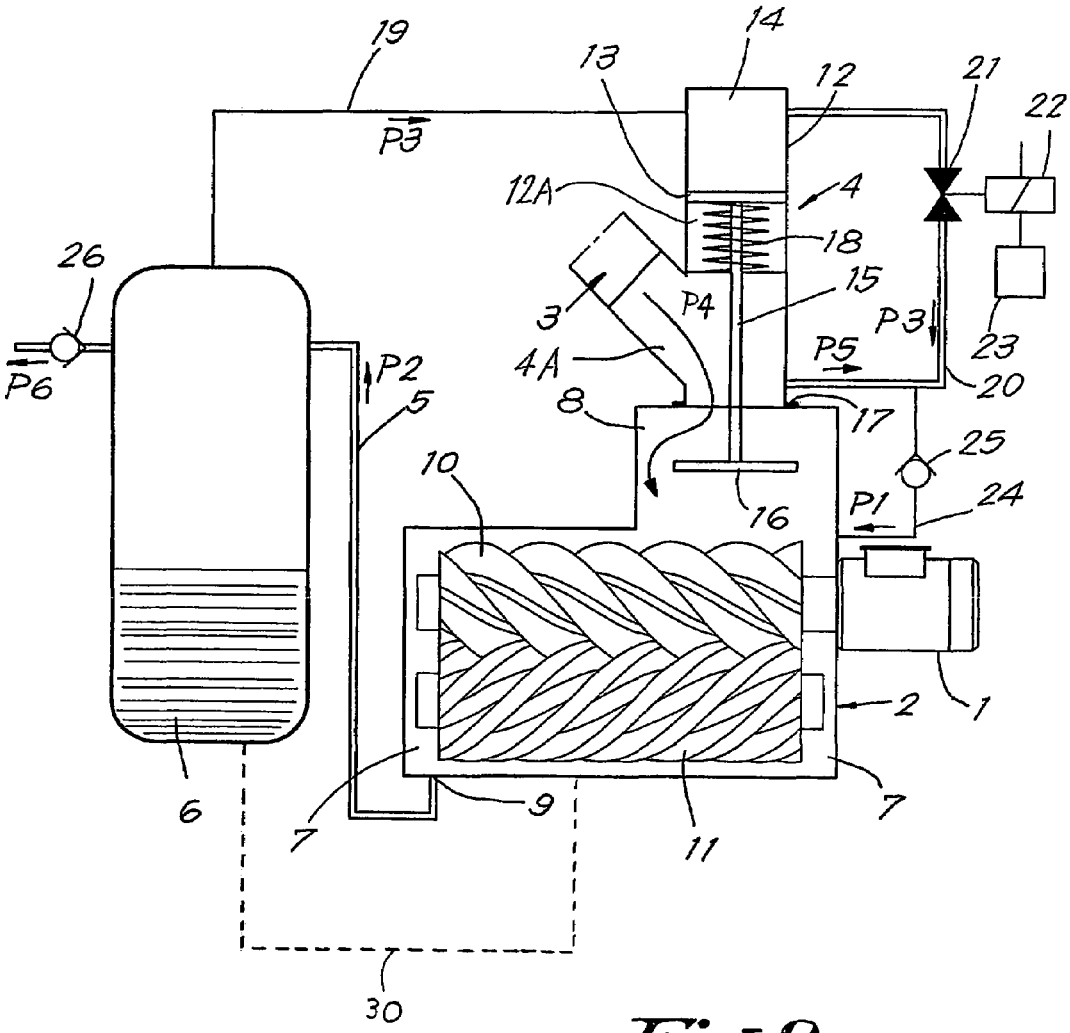

With the intention of better showing the characteristics of the invention, hereafter, as an example without any limitative character, a preferred form of embodiment is described of a volumetric compressor according to the invention, with reference to the accompanying drawings, wherein:

FIG. 1 schematically represents such compressor in unloaded condition:

FIG. 2 schematically represents the compressor from FIG. 1, however, in loaded condition.

The volumetric compressor schematically represented in the figures is a screw compressor which comprises a compressor element 2, driven by a motor 1, to which an inlet conduit 3 with therein an inlet valve 4 and a pressure conduit 5 with therein a pressure vessel 6 are connected.

The compressor element 2 comprises a compression chamber 7, provided with an inlet 8, to which the inlet conduit 5 connects, and an outlet 9, to which the pressure conduit 3 connects.

In this compression chamber 7, two cooperating screw-shaped rotors 10 and 11 are provided.

The inlet valve 4 substantially consists of a housing 12 forming a cylinder, which housing is provided with a hollow space 12A in which a piston 13 can be moved. Between the operative surface of the piston 13 and the housing, a cylinder chamber 14 is formed. At the other side, the piston 13, by means of a plunger 15, is connected to a valve element 16 which is situated in the compression chamber and cooperates with a valve seat 17 provided in the inlet 8.

A springy element in the shape of a compression spring 18 surrounds the plunger 15, between a part of the housing 12 and the piston 13, and pushes the piston 13 away and, therefore, the valve element 16 towards or against the valve seat 17.

A control conduit 19 gives out into the cylinder chamber 14, onto the extremity turned away from the valve element 16.

To this extremity, also a connection conduit 20 is connected which thus connects the cylinder chamber 14 to the inlet conduit 3, more particularly the part of the passage 4A of the inlet valve 4, situated upstream in respect to the valve element 16.

In this connection conduit 20, a load valve 21 is provided which is controlled by a relay 22, the actuation of which is determined by a control device 23.

The minimum flow section of this connection conduit 20 is larger than the minimum flow section of the control conduit 19.

The minimum flow section of the connection conduit 20 mostly can be found at the height of the load valve 21, on account of the fact that this flow section, at opposite sides of the load valve 21, is constant and larger.

Also, the control conduit 19 mostly, as represented in the figures, has a constant flow section which then is equal to the minimum flow section.

The control conduit 19, however, also may comprise a part with a larger flow section and, for example, in an example not represented, may connect to the cylinder chamber 14 by means of the part, situated between this cylinder chamber 14 and the load valve 21, of the connection conduit 20 which has a larger flow section.

The valve element 16 is bypassed by means of a bypass 24 with therein a return valve 25. This bypass 24 thus gives out at the suction side in the compression chamber 7, and, in the represented form of embodiment, connects to the part between the load valve 21 and the passage of the inlet valve 16 and in this manner, thus, to the inlet conduit 3.

In a variant, the bypass 24 can connect directly to the inlet conduit 3 or the passage 4A of the inlet valve 4.

The minimum flow section of this bypass 24 clearly is smaller than the minimum flow section of the inlet conduit 3.

At the outlet of the pressure vessel 6, a minimum-pressure valve 26 is installed.

The working of the inlet valve 4 is as follows:

Before the compressor is started, the pressure in the pressure vessel 6 and, thus, in the cylinder chamber 14, too, as well as in the compression chamber 7, is the atmospheric pressure. The inlet valve 4 is pushed by the pressure spring 18 into closed position, against the valve seat 17. The control device 23 commands the relay 22 such that the load valve 21 is open.

When the compressor element 2 is driven by the motor 1, in the beginning a limited amount of air is suctioned into the compression chamber 7, through inlet conduit 3 and bypass 24.

In FIG. 1, the compressor is represented in this unloaded condition, whereby the flow of the suctioned air is represented by arrows P1.

This air is compressed and, through pressure conduit 5, gets into the pressure vessel 6, as indicated by P2 in FIG. 1. As the load valve 21, when starting up, is open, air is also suctioned from the pressure vessel 6 by means of the control conduit 19, the cylinder chamber 14, the connection conduit 20 and the bypass 24, as represented in FIG. 1 by arrows P3.

As a consequence, an equilibrium situation is created, whereby a small overpressure is prevailing in the pressure vessel 7.

As the minimum flow section of the connection conduit 20 is much larger than the minimum flow section of the control conduit 19, the pressure in the cylinder chamber 14 will be approximately equal to the pressure in the inlet conduit 3. The inlet valve 4 thus remains closed.

By giving a signal to the relay 22, the control device 23 commands the closing of the load valve 21. As a result, the pressure in the cylinder chamber will rise up to the same level as the pressure in the pressure vessel 6, in consideration of the fact that no air will be suctioned from this chamber any longer.

The pressure in the pressure vessel 6 rises as practically no air is suctioned away through control conduit 19.

When the pressure in said chamber has achieved a well-defined value, the piston 13 is pushed away against the pressure of pressure spring 18, such that the valve element 16 removes itself from the valve seat 17. The inlet valve 4 then is open.

In FIG. 2, the compressor is represented in the condition after this opening.

Now, air is flowing directly from the inlet conduit 3 into the compression chamber 7, as represented by arrow P4, and another small portion by means of the bypass 24, as indicated by arrow P5.

When the pressure in the pressure vessel 6 arrives at minimum pressure, the minimum pressure valve 26 opens and compressed air from the vessel 6 is directed towards the consumer, as represented by arrow P6.

When the relay 22 no longer is actuated, the load valve 21 is opened again. As the minimum flow section of the connection conduit 20 is much larger than that of the control conduit 19, the pressure in the cylinder chamber 14 drops rapidly until it is approximately equal to the pressure at the inlet conduit 3.

Under the influence of pressure spring 18, the inlet valve 4 will close rapidly. Then, the compressor element 2 can suction air only through the bypass 24 and the return valve 25.

The air from the pressure vessel 6, which still is under pressure, is blown off through control conduit 19, cylinder chamber 14, connection conduit 20 and the passage 4A of the inlet valve 4, until a new equilibrium is achieved, with a small overpressure in the pressure vessel 6.

The condition represented in FIG. 1 is achieved, and the compressor again is working without load.

The construction of the inlet valve 4 and the control thereof are simple, and the working is reliable.

The omission of the pressure in the cylinder chamber 14 does not take place by means of unreliable valves with springs, however, by means of creating an unequilibrium in the pressure drop over the connection between the pressure vessel 6 and the inlet conduit 3, this is control conduit 19, cylinder chamber 14 and connection conduit 20, and this in that the minimum flow section of the control conduit 19 clearly is smaller than the minimum flow section of the connection conduit 20.

With such inlet valve 4 and control, no valve is required at the outlet 9 of the rotor chamber 7 or in the pressure conduit 5.

If the compressor 1 is of the type whereby lubrication liquid is injected into the rotor chamber 7 and this lubrication liquid is separated in the pressure vessel 6 and fed back for injection by means of a return conduit, then also no valve in the return conduit will be necessary. As generally known in the art, the lubrication liquid can be provided from any suitable source such as, for example, from an injection line/return conduit 30, as shown in a dashed line in FIGS. 2 and 3 by way of a non-limitative example.

The invention is in no way limited to the form of embodiment described heretofore and represented in the accompanying figures, however, such volumetric compressor can be manufactured in various variants, without leaving the scope of the invention.

The invention claimed is:

1. Volumetric compressor, comprising a compressor element, injected by lubricating liquid, with a compression chamber, to which an inlet conduit, which can be closed off by means of an inlet valve, and a pressure conduit, in which a pressure vessel is installed, are connected, whereby the inlet valve comprises a valve element cooperating with a valve seat, said element being connected to a piston which can be displaced in a hollow space in a cylinder-forming housing, and a springy element which pushes this valve element towards the valve seat, whereas a control conduit puts the interior of the pressure vessel into connection with a cylinder chamber which is formed between the operative side of the piston and the housing, wherein the valve element is bypassed by a bypass with therein a return valve allowing only a flow towards the compression chamber, and the cylinder chamber is connected to the inlet conduit by means of a connection conduit, with therein a load valve which can be controlled by means of a control device, wherein a minimum cross-section of this connection conduit, with open load valve, is larger than a minimum cross-section of the control conduit.

2. Volumetric compressor according to claim 1, wherein the bypass, by means of a part of the connection conduit, situated between the load valve and the inlet conduit, connects to this inlet conduit.

3. Volumetric compressor according to claim 1, wherein the control conduit is directly connected to the cylinder chamber.

4. Volumetric compressor according to claim 1, wherein the load valve is a valve controlled by a relay, wherein the actuation of this relay is determined by the control device.

* * * * *